US005241042A

United States Patent [19]

Petrea et al.

[11] Patent Number: 5,241,042

[45] Date of Patent: Aug. 31, 1993

[54] FINISH FOR TEXTILE FIBERS CONTAINING POLYALPHAOLEFIN AND NONIONIC EMULSIFIERS HAVING A PLURALITY OF HYDROCARBON CHAINS

[75] Inventors: Randy D. Petrea; Robert L. Schuette, both of Spartanburg, S.C.

[73] Assignee: Milliken Research Corporation, Spartanburg, S.C.

[21] Appl. No.: 806,990

[22] Filed: Dec. 13, 1991

[51] Int. Cl.[5] ..... C08K 5/06; D06M 15/00

[52] U.S. Cl. ..... 524/377; 524/376; 524/378; 252/8.8; 252/8.9; 252/49.5; 8/115.6

[58] Field of Search ..... 252/8.8 R, 8.9, 49.5; 8/115.6; 524/376, 377, 378, 310

[56] References Cited

U.S. PATENT DOCUMENTS

| | | | |
|---|---|---|---|
| 2,965,678 | 12/1960 | Sundberg et al. | 524/376 |
| 3,989,661 | 11/1976 | Bondy | 524/310 |
| 4,240,795 | 12/1980 | Hendrix | 8/115.6 |
| 4,299,994 | 11/1981 | Stahel | 252/8.9 |
| 4,767,556 | 8/1988 | Childers et al. | 8/115.6 |
| 4,995,884 | 2/1991 | Ross et al. | 8/115.6 |
| 4,999,120 | 3/1991 | Seemuth | 252/8.6 |

*Primary Examiner*—Paul R. Michl
*Assistant Examiner*—La Vonda DeWitt
*Attorney, Agent, or Firm*—Timothy J. Monahan; Terry T. Moyer

[57] ABSTRACT

A fiber finish composition, which may be applied as an aqueous emulsion, is provided having:

(a) from 70 to 95 parts by weight of a polyalphaolefin oil;

(b) from 5 to 30 parts by weight of an emulsifier selected from:

(i) ethoxylated $C_{12}$–$C_{36}$ branched alcohols;

(ii) alkoxylated polyhydric alcohols having at least 3 hydroxyl sites which are esterified with $C_{12}$–$C_{36}$ fatty acids;

(iii) alkoxyated glycerol esters of $C_{12}$–$C_{36}$ fatty acids having at least one hydroxyl functionality.

20 Claims, No Drawings

FINISH FOR TEXTILE FIBERS CONTAINING POLYALPHAOLEFIN AND NONIONIC EMULSIFIERS HAVING A PLURALITY OF HYDROCARBON CHAINS

BACKGROUND OF THE INVENTION

This invention relates generally to a lubricating composition for finishing synthetic textile fibers, and in particular to a composition containing a polyalphaolefin oil and an improved emulsifier having a polyoxyalkylene chain and a hydrophobic component having a plurality of $C_4$–$C_{32}$ aliphatic groups.

Synthetic polymers are made into fibers in the form of continuous filaments, usually by a process of melt spinning. The filaments are cooled and converted into filament yarn, staple or tow. Typically, a lubricant composition or finish is applied to the fibers to aid in processing operations by reducing friction, dissipating static charges and modifying the pliability and yarn bundle forming characteristics of the fibers. The finish should be relatively non-absorbent, since this can adversely affect the strength and elasticity of the fibers. Also, as the finish is absorbed, the fibers tends to swell, lubrication is lost and friction increases. Another requirement of the finish is that it should be removable from the fiber by conventional procedures.

Mineral oil was one of the first compositions used as a fiber finish for synthetic fibers. However, due to the high degree of absorption of mineral oil into some fibers, especially elastomeric polyurethanes, mineral oils have been replaced by polysiloxane oils.

The polysiloxane oils provide better lubrication and are generally absorbed less by the fibers. In particular, polysiloxane oils have been useful in conjunction with polymers that are especially sensitive to the deleterious effects of absorption of lubricants, such as elastomeric polyurethane (spandex) fibers. Although polysiloxane oils have been used on elastomeric polyurethanes for well over twenty years, there are several drawbacks associated with the processing of fibers treated with these oils. The polysiloxane oils do not offer the cohesion needed to keep yarn bundles or packages together, and package degradation is noticed with time. The lack of boundary friction associated with the polysiloxane oils also leads to irregularities in yarn package formation, such as saddling and bulging, and limits yarn package size.

Safety and environmental concerns also militate against the use of polysiloxane oils as fiber finishes. Beam drippings of the polysiloxane on the floors of processing plants creates an environment ripe for slipping accidents. This danger is exacerbated by the difficulty of removing polysiloxane oils from the floor. Environmentally, the polysiloxane oils have come under attack in that the oils do not readily biodegrade. Furthermore, since the polysiloxane oils tend to propagate a flame, oil which remains on the yarn after fabric formation can significantly increase the flammability of fabric. Thus, the use of polysiloxane oils by the textile industry is coming under increased regulation.

A polyalphaolefin based fiber finish is disclosed in Ross et al., U.S. Pat. No. 4,995,884. The patent discloses a finish composition comprising from 30 to 70 wt. % of a polyalphaolefine, 25 to 50 wt. % of an emulsifier and 5 to 20 wt. % of an antistatic agent. Specific examples of finish formulations having from 37.6 to 56.6 wt. % polyalphaolefin are provided in the patent. The finish composition is applied to the fiber as an aqueous emulsion. Any suitable emulsifying agent may be used and several commercially available emulsifiers are recommended.

While it is often desirable to provide a finish as an emulsion from the viewpoint of ease of application and removal from the textile fiber, emulsifiers generally have a negative impact on performance of the lubricant. Additionally, the emulsifier may absorb into the textile fiber resulting in swelling and weakening of the fiber.

SUMMARY OF THE INVENTION

Therefore, one of the objects of the invention is to provide a fiber finish which will lubricate the fiber during processing operations, will not cause degradation or swelling of the fiber, will not adversely affect yarn package formation, and can be removed from the fiber by conventional washing and scouring operations.

Another object of the present invention is to provide a fiber finish adapted for use on synthetic fibers, particularly elastomeric polyurethane fibers.

Still another object of the invention is to provide a finish composition having a high percentage of polyalphaolefin oil which may be applied to the fiber as an aqueous emulsion, and wherein the emulsifier is not absorbed by the fiber or does not otherwise detract from finish performance.

Accordingly, a finish composition is provided with from 50 to 95 wt. % of a polyalphaolefin oil and from 5 to 50 wt. % of an emulsifier having a polyoxyalkylene chain and a hydrophobic component characterized by at least two $C_4$–$C_{32}$ aliphatic chains or branches. Preferably, the hydrophobic component of the emulsifier has at least two $C_6$–$C_{24}$ aliphatic chains and an HLB value of from 6 to 13.

The finish composition imparts superior hydrodynamic and boundary frictional characteristics to fiber and yarn, has negligible adverse impact on the physical properties of the fiber, shows minimal absorption into synthetic fibers, especially spandex, and is relatively easy to remove from the fiber. The finish composition features a relatively high concentration of a branched hydrocarbon lubricant and an emulsifier with multiple hydrocarbon chains or branches. The finish may be applied to the fiber as an emulsion and is easily removed from the fiber by scouring.

DESCRIPTION OF THE PREFERRED EMBODIMENT OF THE INVENTION

Without limiting the scope of the invention, the preferred features of the invention are set forth.

The fiber finish composition of the present invention contains a polyalphaolefin lubricant and an emulsifier. The composition may be applied to a textile fiber neat or as an oil in water emulsion. Emulsions may be prepared by any conventional technique, for example high speed mixing, using approximately 3 to 25 wt. % of the finish in the aqueous emulsion, preferably 10 to 20 wt. % of the finish in the aqueous emulsion.

Preferred polyalphaolefines include trimers, tetramers, pentamers and hexamers of alpha olefins, especially octene-1, decene-1, dodecene-1 and tetradecene-1. Commercially available polyalphaolefins typically contain a distribution of oligomers—those predominantly comprised of trimers are preferred. Polyalphaolefines having utility herein may be characterized by a viscosity of 2 to 10 centistokes at 100° C., preferably 4 to 8 centistokes at 100° C., a smoke point greater than 300° F. Examples of suitable polyalphaolefins include Ethylflo 162, 164, 166, 168 and 170, manufactured and distributed by Ethyl Corporation, Baton Rouge, La.

The polyalphaolefin lubricant comprises from 50 to 95 wt. % of the finish composition. It is desirable to maximize the concentration of lubricant in the finish composition, provided that a sufficient level of an emulsifier is present to facilitate removal of the lubricant from the textile fiber when so desired, and when the finish is applied as an emulsion, a sufficient level of emulsifier to maintain a stable emulsion. Thus, ranges of polyalphaolefin i the finish composition of from 70 to 95 wt. % are preferred, with ranges of 75 to 90 wt. % being most preferred.

An emulsifier is present in the finish composition in ranges from 5 to 50 wt. %, preferably from 5 to 30 wt. %, and more preferably from 10 to 25 wt. %. It has been found that these relatively low levels of emulsifiers may be used in the finish composition without sacrificing the performance of the finish by selecting relatively high molecular weight, nonionic emulsifiers having a plurality of hydrocarbon chains or branches. Without being bound to a particular theory, it is hypothesized that the multiple hydrocarbon chains or branches of the hydrophobic component of the emulsifier (1) provide a site for enhanced interaction with the branched hydrocarbon functionality of the polyalphaolefins to form a stable emulsion in an aqueous solution and to facilitate removal of the lubricant from the textile fiber during scouring; and (2) minimize absorption of the emulsifier into the textile fiber.

The following emulsifiers have been found to meet the performance criteria of the present fiber finish composition:

(A) branched alcohols having at least two aliphatic chains of $C_4$–$C_{32}$ and from 12 to 36 total carbon atoms, which have been alkoxylated with from 3 to 20 moles of alkylene oxides selected from ethylene oxide, propylene oxide and glycidol, preferred features include from 3 to 12 moles of alkylene oxides and at least 50% of the moles of alkylene oxide being ethylene oxide. More preferably, at least 75 mole % of the alkylene oxides are ethylene oxide. Especially useful are branched alcohols having $C_6$–$C_{24}$ alkyl chains and a total of 12 to 28 carbon atoms, notably $C_{12}$–$C_{28}$ Guerbet alcohols such as octyldodecanol and isoeicosyl alcohol;

(B) $C_3$–$C_{90}$ polyhydric alcohols, including long chain alcohols and oligomers of the same, having at least three hydroxyl sites, which have been alkoxylated with from 5 to 200 moles of alkylene oxides selected from ethylene oxide, propylene oxide, butylene oxide and glycidol, followed by esterification in an acidic medium with 1 to 6 moles of a $C_{12}$–$C_{36}$ fatty acid; preferably the fatty acids are branched and have a total of 12 to 28 carbon atoms, for example to iso-stearic acid. Decreased absorption of the emulsifier may be achieved by first reacting a secondary hydroxyl forming alkylene oxide such as propylene oxide or butylene oxide with any primary hydroxyl groups of the polyhydric alcohol, followed by alkoxylation as described above. Preferred features include $C_3$–$C_6$ polyhydric alcohols, alkoxylation with 5 to 40 moles of alkylene oxides, and at least 50% of the moles of alkylene oxide being ethylene oxide, more preferably at least 75 mole % are ethylene oxide; and (C) glyceryl esters of $C_{12}$–$C_{36}$ fatty acids wherein the fatty acids have at least one hydroxyl functionality, and the hydroxyl functionalities have been alkoxylated with a total of from 50 to 250 moles of alkylene oxides selected from the ethylene oxide, propylene oxide and glycidol, preferred features include alkoxylation with 150 to 250 moles of alkylene oxides and at least 50% of the moles of alkylene oxide being ethylene oxide. More preferably at least 75 mole % of the alkylene oxides are ethylene oxide. Glyceryl esters of $C_{12}$–$C_{24}$ fatty acids are preferred, for example, castor oil may be alkoxylated as described above to provide an emulsifier.

The nonionic emulsifiers may be employed alone or in combination.

The above emulsifiers may be synthesized by base-catalyzed alkoxylation with, for example, a potassium hydroxide catalyst. Comparable results may be achieved by other techniques known to those with skill in the art. Ethylene oxide and propylene oxide are generally preferred alkylene oxides.

Emulsifiers having an HLB value of between 6 and 13 are recommended, with those having an HLB between 7 and 12 being preferred. HLB values of between 8.5 and 10.5 are most preferred.

In addition to the non-ionic emulsifiers described above, up to 10 wt. % of the finish composition may be a cationic or anionic emulsifier, preferably from 3 to 7 wt. % of an ionic emulsifier. By way of example, the ionic emulsifiers may be selected from phosphated $C_{10}$–$C_{15}$ monohydric alcohol alkoxylates, having from 4 to 10 moles of ethylene oxide residues and ethoxylated quaternary amine compounds such as Cordex AT-172, manufactured by Finetex, Inc., Spencer, N.C.

Minor amounts of additives may constitute up to 15 wt. % of the finish composition. For example, viscosity modifiers, low sling additives such as polyisobutylene (up to 5 wt. %), antistatic agents (up to 5 wt %) and water may be added to the finish composition without deviating from the scope of the invention.

The finish composition is applied to a textile fiber by any number of known methods, such as from a kiss roll, pad, bath or spray nozzle, to provide a lubricated fiber comprising approximately 0.4 to 7 wt. % of the finish composition. Typically, the finish composition comprises from 0.7 to 3 wt. % of the lubricated fiber.

The finish composition may be used neat, with the addition of minor amounts of water or as an emulsion containing from 3 to 25 wt. % of the composition in water. For most applications, emulsions which are stable for 8 hours will be adequate. If it is desirable to operate with the maximum level of polyalphaolefins, emulsions which are stable for less than 8 hours may be employed, provided the emulsion is used relatively quickly or is agitated.

The finish composition herein is useful on a wide range of textile fibers, particularly synthetic textile particularly synthetic textile fibers such as polyurethanes, especially elastomeric polyurethanes (spandex), polyesters, polyamides, especially Nylon 6 and Nylon 66, polyolefins, especially polypropylene, polyethylene and block and random copolymers thereof, and acrylics. The finish composition is particularly useful whenever there is a tendency of the fiber to absorb the finish, as is the case with several of the synthetic fibers. In the past, spandex fibers have proven difficult to lubricate during finishing operations without the finish absorbing into the fiber or otherwise causing fiber degradation. As used throughout, the terms "spandex" or "elastomeric polyurethanes" are intended to refer to block copolymers made by reaction of diisocyanates with hydroxylp-terminates, low molecular weight polymers (macroglycols) and diamines or glycols (chain extenders) which creates relatively soft and hard segments in the copolymer. See Encyclopedia of Polymer Science and Engineering, Volume 6, pp. 718-19, 733-55 (1986).

Preferably, the finish composition has the following properties:

1. A neat viscosity of less than 200 centipoise @25° C.
2. A polyurethane absorption of less than 3 percent by weight of elastomeric polyurethane.
3. An emulsification effectiveness as measured by the presence of a stable emulsion at 25° C. lasting for at least 8 hours.
4. Fiber to metal hydrodynamic friction on polyester and nylon of less than 1.06 and 0.99, respectively.
5. Fiber to fiber boundary friction on polyester and nylon of less than 0.27 and 0.37, respectively.

The invention may be further understood by reference to the following examples, but the invention is not intended to be unduly limited thereby. Unless otherwise indicated, all parts and percentages are by weight. The abbreviations EO and PO represent ethylene oxide and propylene oxide residues respectively.

Examples 1-4 demonstrate preferred formulations of the finish composition for application to a textile fiber as an emulsion.

EXAMPLE 1

In a typical experiment, 80 grams of a 4 centistoke poly alpha olefin, provided by the Ethyl Corporation, was placed in a 250 ml beaker equipped with a magnetic stir bar. 20 grams of 2-octyldodecanol 7EO was then added to the beaker. The mixture was then agitated to provide a uniform mixture. To this mixture, 5.3 grams of C12-C15 SEO phosphate, and 4.5 grams castor oil 200EO was added respectively. The resulting mixture was allowed to stir for 5 minutes. 2.9 grams of water was then added to provide a clear stable mixture.

EXAMPLE 2

In a typical experiment, 80 grams of a 6 centistoke poly alpha olefin, provided by the Ethyl Corporation, was placed in a 250 ml beaker equipped with a magnetic stir bar, 20 grams of 2-octyldodecanol 7EO was then added to the beaker. The mixture was then added to the beaker. The mixture was then agitated to provide a uniform mixture. To this mixture, 5.3 grams of C12-C15 SEO phosphate, and 4.5 grams castor oil 200EO was added respectively. The resulting mixture was allowed to stir for 5 minutes. 2.9 grams of water was then added to provide a clear stable mixture.

EXAMPLE 3

In a typical experiment, 80 grams of a 4 centistoke polyalpha olefin, provided by the Ethyl Corporation, was placed in a 250 ml beaker equipped with a magnetic stir bar. 10 grams of 2-octyldodecanol 7EO and 10 grams of Sorbitol 2PO 28EP penta-isostearate was then added to the beaker. The mixture was then agitated to provide a uniform mixture. To this mixture, 5.3 grams of C12-C15 5EO phosphate, and 4.5 grams castor oil 200EO was added respectively. The resulting mixture was allowed to stir for 5 minutes. 2.9 grams of water was then added to provide a clear stable mixture.

EXAMPLE 4

In a typical experiment, 80 grams of a 6 centistoke poly alpha olefin, provided by the Ethyl Corporation, was placed in a 250 ml beaker equipped with a magnetic stir bar. 10 grams of 2-octyldodecanol 7EO and 10 grams of Sorbitol 2PO 28EO penta-isostearate was then added to the beaker. The mixture was then agitated to provide a uniform mixture. To this mixture, 5.3 grams of C12-C15 5EO phosphate, and 4.5 grams castor oil 200EO was added respectively. The resulting mixture was allowed to stir for 5 minutes. 2.9 grams of water was then added to provide a clear stable mixture.

Examples 5-8 demonstrate preferred formulations of the finish composition for application to a textile fiber neat.

EXAMPLE 5

In a typical experiment, 90 grams of 4 centistoke poly alpha olefin, provided by the Ethyl Corporation, was placed in a 250 ml beaker equipped with a magnetic stir bar. 10 grams of Sorbitol 2PO 28EO penta-isostearate was then added to the beaker. The mixture was then agitated to provide a uniform mixture. The resulting mixture was allowed to stir for 5 minutes.

EXAMPLE 6

In a typical experiment, 90 grams of 6 centistoke poly alpha olefin, provided by the Ethyl Corporation, was placed in a 250 ml beaker equipped with a magnetic stir bar. 10 grams of Sorbitol 2PO 28EO penta-isostearate was then added to the beaker. The mixture was then agitated to provide a uniform mixture. The resulting mixture was allowed to stir for 5 minutes.

EXAMPLE 7

In a typical experiment, 90 grams of a 50/50 blend of 4 centistoke and 6 centistoke poly alpha olefin, both provided by the Ethyl Corporation, was placed in a 250 ml beaker equipped with a magnetic stir bar. 10 grams of Sorbitol 2PO 28EO penta-isostearate was then added to the beaker. The mixture was then agitated to provide a uniform mixture. The resulting mixture was allowed to stir for 5 minutes.

EXAMPLE 8

In a typical experiment, 90 grams of a 80/20 blend of a 4 centistoke and 6 centistoke poly alpha olefin, both provided by the Ethyl Corporation, was placed in a 250 ml beaker equipped with a magnetic stir bar. 10 grams Sorbitol 2PO 28EO penta-isostearate was then added to the beaker. The mixture was then agitated to provide a uniform mixture. The resulting mixture was allowed to stir for 5 minutes.

Examples 9-12 demonstrate preferred formulations of the finish composition for application to a textile fiber neat with a low sling additive, Tebeflex 200, a polyisobutylene mixture.

EXAMPLE 9

In a typical experiment, 90 grams of 4 centistoke poly alpha olefin, provided by the Ethyl Corporation, was placed in a 250 ml beaker equipped with a magnetic stir bar. 10 grams of Sorbitol 2PO 28EO penta-isostearate and 2 grams of Tebeflex 200, purchased from Boehme Filatex, was then added to the beaker. The mixture was then agitated to provide a uniform mixture. The resulting mixture was allowed to stir for 5 minutes.

EXAMPLE 10

In a typical experiment, 90 grams of 6 centistoke poly alpha olefin, provided by the Ethyl Corporation, was placed in a 250 ml beaker equipped with a magnetic stir bar. 10 grams of Sorbitol 2PO 28EO penta-isostearate and 2 grams of Tebeflex 200 was then added to the beaker. The mixture was then agitated to provide a uniform mixture. The resulting mixture was allowed to stir for 5 minutes.

EXAMPLE 11

In a typical experiment, 90 grams of a 50/50 blend of a 4 centistoke and 6 centistoke poly alpha olefin, both provided by the Ethyl Corporation, was placed in a 250 ml beaker equipped with a magnetic stir bar. 10 grams of Sorbitol 2PO 28EO penta-isostearate and 2 grams Tebeflex 200 was then added to the beaker. The mixture was then agitated to provide a uniform mixture. The resulting mixture was allowed to stir for 5 minutes.

EXAMPLE 12

In a typical experiment, 90 grams of a 80/20 blend of a 4 centistoke and 6 centistoke poly alpha olefin, both provided by the Ethyl Corporation, was placed in a 250 ml beaker equipped with a magnetic stir bar. 10 rams of Sortibol 2PO 28EO penta-isostearate and 2 grams Tebeflex 200 was then added to the beaker. The mixture was then agitated to provide a uniform mixture. The resulting mixture was allowed to stir for 5 minutes.

EVALUATION OF THE PRODUCT

The following tests were run on the spin finish to evaluate frictional characteristics versus polysiloxanes and also compatibility with polyurethane fiber.

Hydrodynamic Friction was evaluated using a Rothschild frictometer. The finish was applied to 70/34 polyester and 70/34 Nylon 6 at 0.75 percent on weight of fiber (OWF) and allowed to condition for at least 24 hours at 72° F. and 63 percent relative humidity. After conditioning, the hydrodynamic fiber to metal friction was obtained on the Rothschild frictometer at fiber speeds of 100 meters/minute and pretensions of 20 grams. Boundary friction were performed likewise, except that the yarn speed was 0.0071 meters/minute and the pretension set at 50 grams.

The compositions or Examples 1-12 were applied to the fiber tested with an Atlab Finish Applicator, at a level of 0.75 OWF.

Polyurethane absorption was measured according to the following procedure:

An elastomeric polyurethane film (2-3 grams) was weighed on an analytical balance, placed in 100 mls. of a 20 wt. % emulsion of the finish composition in water and the mixture stirred for 6 minutes. The polyurethane film was then removed, rinsed with water, and allowed to dry. The resulting weight increase of the polyurethane film was then calculated and expressed as the percent absorption.

Viscosity Measurements were performed using a Brookfield Viscometer operating at either 30 or 60 rpm's and employing a number 1 spindle. All measurements were taken at 25° C.

Smoke points were determined using the Cleveland Open Cup method. One hundred grams of the product was placed in the cup and heated. Using a thermometer immersed in the product, the smoke point was recorded at the temperature at which the first smoke became evident.

Table 1 represents various polyurethane absorption data as measured by the described procedure, for the preceding examples.

TABLE 1

| POLYURETHANE ABSORPTIONS | |
|---|---|
| PRODUCT | PERCENT ABSORPTION |
| EXAMPLE 1 | 0.62 |
| EXAMPLE 2 | 0.22 |
| EXAMPLE 3 | 0.10 |
| EXAMPLE 4 | 0.26 |
| EXAMPLE 5 | 0.67 |
| EXAMPLE 6 | 0.82 |
| EXAMPLE 7 | 0.06 |
| EXAMPLE 8 | 0.49 |
| EXAMPLE 9 | 0.68 |
| EXAMPLE 10 | 0.86 |
| EXAMPLE 11 | 1.00 |
| EXAMPLE 12 | 0.43 |

Table 2 lists the viscosity as measured by the described procedures for the examples of this invention.

TABLE 2

| VISCOSITY DATA | |
|---|---|
| FINISH | VISCOSITY, cps |
| EXAMPLE 1 | 109.6 |
| EXAMPLE 2 | 152.0 |
| EXAMPLE 3 | 84.8 |
| EXAMPLE 4 | 163.0 |
| EXAMPLE 5 | 38.0 |
| EXAMPLE 6 | 62.5 |
| EXAMPLE 7 | 52.0 |
| EXAMPLE 8 | 44.0 |
| EXAMPLE 9 | 48.5 |
| EXAMPLE 10 | 78.0 |
| EXAMPLE 11 | 56.0 |
| EXAMPLE 12 | 48.5 |

Tables 3 and 4 lists the hydrodynamic and boundary frictions on nylon and polyester, respectively, as measured by the described procedure, for the examples of the invention. The silicone finish tested was a 20 centistoke, polydimethylsiloxane.

TABLE 3

| BOUNDARY AND HYDRODYNAMIC FRICTIONS ON 70/34 NYLON | | | | | | |
|---|---|---|---|---|---|---|
| | HYDRODYNAMIC | | BOUNDARY | | | |
| CHEMICAL | F/M | F/F | F/M KINETIC | F/M STATIC | F/F KINETIC | F/F STATIC |
| SILICONE | 0.28 | 0.20 | 0.13 | 0.17 | 0.20 | 0.35 |
| EXAMPLE 1 | 0.74 | 0.39 | 0.10 | 0.13 | 0.15 | 0.19 |
| EXAMPLE 2 | 0.89 | 0.46 | 0.08 | 0.12 | 0.14 | 0.19 |
| EXAMPLE 3 | 0.75 | 0.39 | 0.08 | 0.12 | 0.15 | 0.18 |
| EXAMPLE 4 | 0.91 | 0.49 | 0.09 | 0.12 | 0.15 | 0.18 |
| EXAMPLE 5 | 0.74 | 0.41 | 0.07 | 0.08 | 0.16 | 0.20 |
| EXAMPLE 6 | 0.92 | 0.49 | 0.08 | 0.09 | 0.17 | 0.21 |
| EXAMPLE 7 | 0.92 | 0.43 | 0.08 | 0.09 | 0.18 | 0.22 |

TABLE 3-continued

| BOUNDARY AND HYDRODYNAMIC FRICTIONS ON 70/34 NYLON | | | | | | |
|---|---|---|---|---|---|---|
| | HYDRODYNAMIC | | BOUNDARY | | | |
| CHEMICAL | F/M | F/F | F/M KINETIC | F/M STATIC | F/F KINETIC | F/F STATIC |
| EXAMPLE 8 | 0.79 | 0.43 | 0.07 | 0.08 | 0.16 | 0.20 |
| EXAMPLE 9 | 0.72 | 0.39 | 0.09 | 0.12 | 0.18 | 0.23 |
| EXAMPLE 10 | 0.98 | 0.46 | 0.09 | 0.12 | 0.17 | 0.21 |
| EXAMPLE 11 | 0.88 | 0.43 | 0.09 | 0.12 | 0.18 | 0.22 |
| EXAMPLE 12 | 0.84 | 0.43 | 0.10 | 0.12 | 0.18 | 0.23 |

TABLE 4

| BOUNDARY AND HYDRODYNAMIC FRICTIONS ON 70/34 POLYESTER | | | | | | |
|---|---|---|---|---|---|---|
| | HYDRODYNAMIC | | BOUNDARY | | | |
| PRODUCT | F/M | F/F | F/M KINETIC | F/M STATIC | F/F KINETIC | F/F STATIC |
| SILICONE | 0.57 | 0.28 | 0.08 | 0.11 | 0.14 | 0.21 |
| EXAMPLE 1 | 0.89 | 0.43 | 0.06 | 0.10 | 0.11 | 0.17 |
| EXAMPLE 2 | 1.04 | 0.49 | 0.08 | 0.12 | 0.11 | 0.16 |
| EXAMPLE 3 | 0.91 | 0.43 | 0.07 | 0.10 | 0.12 | 0.18 |
| EXAMPLE 4 | 1.05 | 0.50 | 0.07 | 0.09 | 0.09 | 0.14 |
| EXAMPLE 5 | 0.86 | 0.49 | 0.06 | 0.09 | 0.09 | 0.14 |
| EXAMPLE 6 | 1.04 | 0.49 | 0.06 | 0.08 | 0.12 | 0.16 |
| EXAMPLE 7 | 0.93 | 0.46 | 0.06 | 0.08 | 0.09 | 0.14 |
| EXAMPLE 8 | 0.93 | 0.44 | 0.06 | 0.08 | 0.09 | 0.14 |
| EXAMPLE 9 | 0.86 | 0.41 | 0.06 | 0.07 | 0.11 | 0.14 |
| EXAMPLE 10 | 1.04 | 0.47 | 0.06 | 0.07 | 0.11 | 0.14 |
| EXAMPLE 11 | 0.96 | 0.46 | 0.07 | 0.08 | 0.11 | 0.14 |
| EXAMPLE 12 | 0.91 | 0.43 | 0.07 | 0.08 | 0.12 | 0.14 |

There are, of course, many alternate embodiments and modifications which are intended to be included within the scope of the following claims.

What we claim is:

1. A fiber finish composition comprising on a neat basis:

(a) from 50 to 95 parts by eight of a polyalphaolefin selected from trimers, tetramers, pentamers and hexamers of octene-1, decene-1, dodecene-1 and tetradecene-1;

(b) from 5 to 50 parts by weight of an emulsifier selected from:

(i) branched alcohols having at least two aliphatic chains of $C_4$–$C_{32}$ and from 12 to 36 total carbon atoms, which have been alkoxyated with from 3 to 30 moles of alkylene oxides selected from ethylene oxide, propylene oxide, butylene oxide and glycidol; and (ii) $C_3$–$C_{90}$ polyhydric alcohols having at least three hydroxyl sites, which have been alkoxylated with from 5 to 200 moles of alkylene oxides selected from ethylene oxide, propylene oxide, butylene oxide and glycidol, provided that if any of said hydroxyl sites are primary alcohols, then said primary alcohols are reacted with a secondary hydroxyl forming alkylene oxide prior to alkoxylation, followed by esterification in an acidic medium with 1 to 6 moles of a $C_{12}$–$C_{36}$ fatty acid.

2. The composition of claim 1 wherein said polyalphaolefin comprises primarily trimers and tetramers of said olefins.

3. The composition of claim 2 wherein at least 50% of said alkylene oxides comprising said emulsifiers are ethylene oxide.

4. The composition of claim 3 wherein said emulsifiers have an HLB of between 6 and 13.

5. The composition of claim 4 having a viscosity of less than 200 centipoise @25° C., a polyurethane absorption of less than 3 percent by weight of elastomeric polyurethane, a fiber to metal hydrodynamic friction on polyester and nylon of less than 1.06 and 0.99, respectively and a fiber to fiber boundary friction on polyester and nylon of less than 0.27 and 0.37, respectively.

6. A fiber finish composition comprising on a neat basis:

(a) from 70 to 95 parts by weight of a polyalphaolefin selected from trimers, tetramers, pentamers and hexamers of octene-1, decene-1, dodecene-1 and tetradecene-1;

(b) from 5 to 30 parts by weight of an emulsifier selected from:

(i) branched alcohols having at least two alkyl chains of $C_6$–$C_{24}$ and from 12 to 28 total carbon atoms, which have been alkoxylated with from 3 to 12 moles of alkylene oxides selected from ethylene oxide and propylene oxide; and (ii) $C_3$–$C_6$ polyhydric alcohols having at least three hydroxyl sites, which have been alkoxylated with from 5 to 40 moles of alkylene oxides selected from ethylene oxide and propylene oxide, followed by esterification in an acidic medium with 3 to 6 moles of a $C_{12}$–$C_{28}$ branched, fatty acid.

7. The composition of claim 6 wherein said polyalphaolefin comprises primarily trimers and tetramers of said olefins.

8. The composition of claim 7 wherein at least 50% of said alkylene oxides comprising said emulsifiers are ethylene oxide.

9. The composition of claim 8 wherein said emulsifiers have an HLB of between 7 and 12.

10. The composition of claim 9 having a viscosity of less than 200 centipoise @25° C., a urethane absorption of less than 3 percent by weight of elastomeric polyurethane. a fiber to metal hydrodynamic friction on polyester and nylon of less than 1.06 and 0.99, respectively and a fiber to fiber boundary friction on polyester and nylon of less than 0.27 and 0.37, respectively.

11. An aqueous emulsion comprising from 3 to 25 wt. % of a finish composition having:

(a) from 70 to 95 parts by weight of a polyalphaolefin selected from trimers, tetramers, pentamers and hexamers of octene-1, decene-1, dodecene-1 and tetradecene-1;

(b) from 5 to 30 parts by weight of an emulsifier selected from:

(i) branched alcohols having at least two alkyl chains of $C_6$–$C_{24}$ and from 12 to 28 total carbon atoms, which have been alkoxylated with from 3 to 12 moles of alkylene oxides selected from ethylene oxide and propylene oxide; and (ii) $C_3$–$C_6$ polyhydric alcohols having at least three hydroxyl sites, which have been alkoxylated with from 5 to 40 moles of alkylene oxides selected from ethylene oxide and propylene oxide, followed by esterification in an acidic medium with 3 to 6 moles of a $C_{12}$–$C_{28}$ fatty acid.

12. The emulsion of claim 11 wherein said polyalphaolefin comprises primarily trimers and tetramers of said olefins.

13. The emulsion of claim 12 wherein at least 50% of said alkylene oxides comprising said emulsifiers are ethylene oxide.

14. The emulsion of claim 13 wherein said finish composition comprises from 75 to 90 part by weight of said polyalphaolefin and from 10 to 25 parts of said emulsifier.

15. The emulsion of claim 14 wherein said emulsifiers have an HLB of between 7 and 12.

16. The emulsion of claim 14 having a viscosity of less than 200 centipoise @25° C., a urethane absorption of less than 3 percent by weight of elastomeric polyurethane, a fiber to metal hydrodynamic friction on polyester and nylon of less than 1.06 and 0.99, respectively and a fiber to fiber boundary friction on polyester and nylon of less than 0.27 and 0.37, respectively.

17. The composition of claim 5 wherein said emulsifier is a branched alcohol having at least two aliphatic chains of $C_4$–$C_{32}$ and from 12 to 36 total carbon atoms, which have been alkoxylated with from 3 to 30 moles of alkylene oxides selected from ethylene oxide, propylene oxide, butylene oxide and glycidol.

18. The composition of claim 10 wherein said emulsifier is a branched alcohol having at least two alkyl chains of $C_6$–$C_{24}$ and from 12 to 28 total carbon atoms, which have been alkoxylated with from 3 to 12 moles of alkylene oxides selected from ethylene oxide and propylene oxide.

19. The composition of claim 12 wherein said emulsifier is a branched alcohol having at least two alkyl chains of $C_6$–$C_{24}$ and from 12 to 28 total carbon atoms, which have been alkoxylated with from 3 to 12 moles of alkylene oxides selected from ethylene oxide and propylene oxide.

20. The composition of claim 12 wherein said emulsifier is a Guerbet alcohol having at least two alkyl chains of $C_6$–$C_{24}$ and from 12 to 28 total carbon atoms, which has been alkoxylated with from 3 to 20 moles of alkylene oxides selected from ethylene oxide and propylene oxide.

* * * * *

UNITED STATES PATENT AND TRADEMARK OFFICE

CERTIFICATE OF CORRECTION

PATENT NO. : 5,241,042

DATED : August 31, 1993

INVENTOR(S) : Randy D. Petrea and Robert L. Schuette

It is certified that error appears in the above-indentified patent and that said Letters Patent is hereby corrected as shown below:

In column 9, line 38, the word "eight" should be changed to "weight".

Signed and Sealed this

Sixth Day of September, 1994

*Attest:*

*Attesting Officer*

BRUCE LEHMAN

*Commissioner of Patents and Trademarks*